US011225936B1

(12) United States Patent
Hu et al.

(10) Patent No.: US 11,225,936 B1
(45) Date of Patent: Jan. 18, 2022

(54) EXHAUST GAS RECIRCULATION SYSTEM FOR A VEHICLE ENGINE

(71) Applicant: FORD GLOBAL TECHNOLOGIES, LLC, Dearborn, MI (US)

(72) Inventors: Liangjun Hu, Bloomfield Hills, MI (US); Eric Matthew Kurtz, Dearborn, MI (US); Daniel Joseph Styles, Canton, MI (US); Daniel William Kantrow, Ann Arbor, MI (US); Darrell Sparks, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/183,570

(22) Filed: Feb. 24, 2021

(51) Int. Cl.

| | |
|---|---|
| ***F02M 26/19*** | (2016.01) |
| ***F02M 26/43*** | (2016.01) |
| *F02M 26/38* | (2016.01) |
| *F02M 35/10* | (2006.01) |

(52) U.S. Cl.
CPC ..... *F02M 26/19* (2016.02); *F02M 26/43* (2016.02); *F02M 26/38* (2016.02); *F02M 35/10222* (2013.01)

(58) Field of Classification Search
CPC ..... F02M 26/19; F02M 26/38; F02M 26/43; F02M 35/10222
See application file for complete search history.

(56) References Cited

U.S. PATENT DOCUMENTS

| | | | | |
|---|---|---|---|---|
| 6,272,851 | B1 * | 8/2001 | Mori | F02M 26/42 60/278 |
| 7,552,722 | B1 * | 6/2009 | Shieh | F02M 26/19 123/568.17 |
| 9,617,895 | B2 * | 4/2017 | Mueller-Haas | F01N 3/208 |
| 2004/0112345 | A1 * | 6/2004 | Bertilsson | F02M 35/112 123/568.17 |
| 2007/0017491 | A1 * | 1/2007 | Maeda | F02M 26/48 123/568.18 |
| 2008/0060624 | A1 | 3/2008 | Grandas | |
| 2015/0040537 | A1 * | 2/2015 | Hicks | B01F 3/04049 60/273 |

(Continued)

FOREIGN PATENT DOCUMENTS

| | | | | |
|---|---|---|---|---|
| DE | 19809862 | A1 * | 9/1999 | F02M 26/19 |
| DE | 10118490 | A1 * | 10/2001 | F02M 35/10222 |

(Continued)

*Primary Examiner* — Ngoc T Nguyen
(74) *Attorney, Agent, or Firm* — David B Kelley; Brooks Kushman P.C.

(57) ABSTRACT

An exhaust gas recirculation system for an engine includes a first conduit, a second conduit, and a mixer. The first conduit is configured to direct a first portion of exhaust gas away from a first exhaust manifold. The second conduit is configured to direct a second portion of exhaust gas away from a second exhaust manifold. The mixer is configured to direct the first and second portions of the exhaust gas from the first and second conduits, respectively, into an engine air intake system. The mixer is arranged to segregate the first and second portions of the exhaust gas while the first and second portions of the exhaust gas are within the mixer. The mixer forms a ring about a perforated tube. The mixer is configured to direct the first and second portions of the exhaust gas into the air intake system via the perforated tube.

20 Claims, 5 Drawing Sheets

(56) References Cited

U.S. PATENT DOCUMENTS

| | | | | |
|---|---|---|---|---|
| 2015/0047330 | A1* | 2/2015 | Zhang | F01N 3/28 60/311 |
| 2016/0153404 | A1* | 6/2016 | Guidi | F02M 26/19 123/568.17 |
| 2016/0160804 | A1* | 6/2016 | Dettloff | F02M 26/19 123/568.17 |
| 2016/0160805 | A1* | 6/2016 | Polcyn | F02M 26/70 123/568.18 |
| 2016/0201610 | A1* | 7/2016 | Dahl | F02M 26/19 123/568.17 |
| 2016/0326938 | A1* | 11/2016 | Zhang | F01N 3/2066 |
| 2017/0120193 | A1* | 5/2017 | Zhang | B01F 3/04049 |
| 2017/0234272 | A1* | 8/2017 | Moravec | F02D 41/0065 123/568.12 |
| 2018/0058388 | A1* | 3/2018 | Zhang | B01F 5/0421 |
| 2019/0017426 | A1 | 1/2019 | Zhang et al. | |
| 2019/0101084 | A1* | 4/2019 | Matt | F04D 29/4213 |
| 2020/0283114 | A1 | 9/2020 | Cornwell | |

FOREIGN PATENT DOCUMENTS

| | | | | |
|---|---|---|---|---|
| DE | 102006017148 | A1 * | 10/2007 | F02M 26/51 |
| GB | 2511501 | A * | 9/2014 | F02M 35/10222 |

* cited by examiner

EXHAUST GAS RECIRCULATION SYSTEM FOR A VEHICLE ENGINE

TECHNICAL FIELD

The present disclosure relates to exhaust gas recirculation systems for internal combustion engines.

BACKGROUND

Internal combustion engines may include exhaust gas recirculation systems that are configured to redirect exhaust gas into the air intake system of the engine in order to reduce emissions.

SUMMARY

A vehicle includes an internal combustion, an air intake system, an exhaust system, and an exhaust gas recirculation system. The internal combustion engine has first and second cylinders. The air intake system is configured to deliver air to each of the first and second cylinders. The exhaust system has a first set of conduits and a second set of conduits. The first set of conduits are configured to direct exhaust gas away from the first cylinder. The second set of conduits are configured to direct exhaust gas away from the second cylinder. The exhaust gas recirculation system has a first tube, a second tube, and a mixer. The first tube is configured to direct a first portion of the exhaust gas away from the first set of conduits. The second tube is configured to direct a second portion of the exhaust gas away from the second set of conduits. The mixer is configured to direct the first and second portions of the exhaust gas from the first and second tubes, respectively, into the air intake system. The mixer forms an annular ring that is disposed about a perforated tube. The mixer is configured to segregate the first and second portions of the exhaust gas while the first and second portions of the exhaust gas are within the mixer. The mixer is configured to direct the first and second portions of the exhaust gas into the air intake system via the perforated tube.

An exhaust gas recirculation system for an engine includes a first conduit, a second conduit, and a mixer. The first conduit is configured to direct a first portion of exhaust gas away from a first exhaust manifold. The second conduit is configured to direct a second portion of exhaust gas away from a second exhaust manifold. The mixer is configured to direct the first and second portions of the exhaust gas from the first and second conduits, respectively, into an engine air intake system. The mixer is arranged to segregate the first and second portions of the exhaust gas while the first and second portions of the exhaust gas are within the mixer. The mixer forms a ring about a perforated tube. The mixer is configured to direct the first and second portions of the exhaust gas into the air intake system via the perforated tube.

A mixer for an engine exhaust gas recirculation system includes a housing. The housing forms an annular ring that defines a central opening. The housing further defines a first conduit and a second conduit. The first conduit extends between a first inlet and a first outlet. The first inlet is configured to establish fluid communication with at least one exhaust manifold. The first outlet is configured to establish fluid communication with an air intake conduit via the central opening. The second conduit extends between a second inlet and a second outlet. The second inlet is configured to establish fluid communication with the at least one exhaust manifold. The second outlet is configured to establish fluid communication with the air intake conduit via the central opening. The first and second conduits are segregated within the annular ring.

DETAILED DESCRIPTION

Figure 1:
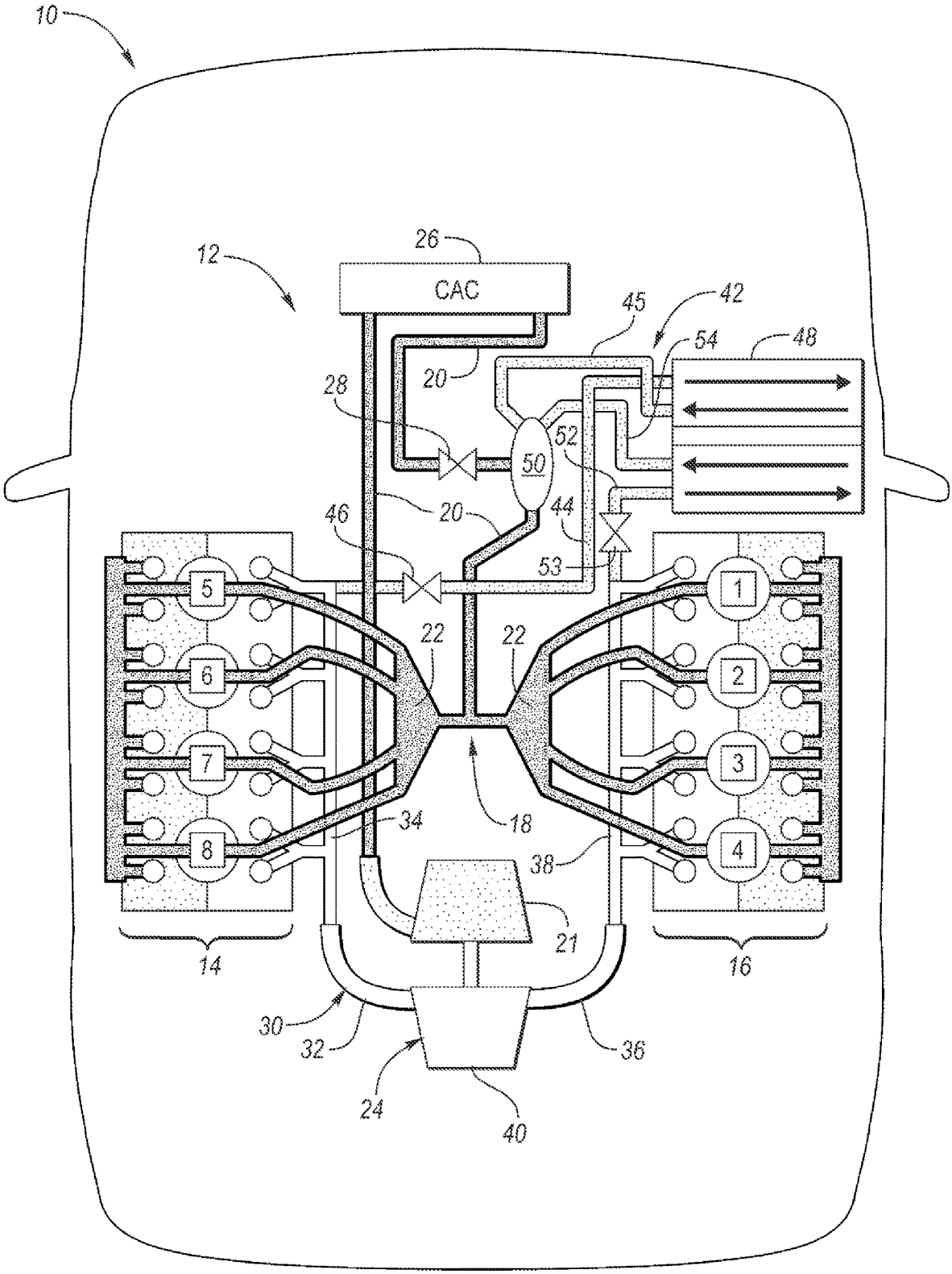
FIG. 1 is a schematic illustration of an exemplary vehicle having an internal combustion engine.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Exhaust gas recirculation is an important method to reduce NOx emissions of an internal combustion engine. With the more stringent emission criteria being established, especially the low NOx emission requirement, there is a strong need to improve the engine exhaust gas recirculation drivability and exhaust gas recirculation distribution uniformity. To meet the low NOx emission, higher exhaust gas relief rate is needed and one technique is to close down the turbocharger to build higher back pressure, which leads to increase in pumping loss and hurts engine efficiency. One method to increase the exhaust gas recirculation drivability is to reduce the pulsation/dynamic energy loss of the exhaust gas before mixing the exhaust gas with the main flow of the air intake. In a single-entry exhaust gas recirculation mixer design, the exhaust gas recirculation flow from two banks of cylinders are mixed before being injected into the main air flow of the air intake. The pulsation energy is lost during the mixing, which reduces the exhaust gas recirculation drivability. With less pulsation energy, there is less penetration of the exhaust gas recirculation flow into the main flow of the air intake, which compromises the exhaust gas recirculation mixing and uniformity.

In the current disclosure, an annular ring mixer design with a dual exhaust gas entry is proposed. The main goal is to maintain the exhaust gas recirculation pulsation/dynamic energy to enhance the exhaust gas recirculation drivability and penetration of the exhaust gas recirculation flow. The exhaust gas recirculation flow is diverted from two banks of the engine separately. The exhaust gas recirculation flow is then cooled in an exhaust gas recirculation cooler. Then the two cooled exhaust gas recirculation flows are introduced into the annular ring exhaust gas recirculation mixer separately. The two exhaust gas recirculation flows do not mix with each other before mixing with the main air flow of the air intake system of the engine. Introducing the two exhaust gas recirculation flows into the main air flow separately reduces the mixing losses and helps to maintain the pulsation energy, which increases the exhaust gas recirculation drivability and the penetration of the exhaust gas recirculation flow into the main air flow of the air intake system.

Referring to FIG. 1, a schematic illustration of an exemplary vehicle 10 having an internal combustion engine 12 is illustrated. The engine 12 may be configured to provide power and torque to wheels to propel the vehicle 10. The engine 12 includes a first bank of cylinders 14 and a second bank of cylinders 16.

The engine 12 includes an air intake system 18. The air intake system 18 includes a set of pipes, tubes, or conduits 20 that are configured to deliver an air supply to each cylinder in order to provide the oxygen required for the combustion of fuel. The set of pipes, tubes, or conduits 20 may include one or more air intake manifolds 22 that directly deliver the air into each cylinder. A first pipe, tube, or conduit of the set of pipes, tubes, or conduits 20 may draw air from the ambient or may receive air from a compressor 21 of a turbocharger 24 or supercharger. If a turbocharger 24 or supercharger is delivering air the air intake system 18, the air may first be sent to a charge air cooler 26. From the charge air cooler 26, the air may then pass by a throttle valve 28, through the air intake manifolds 22 and into the cylinders of the first bank of cylinders 14 and the second bank of cylinders 16. The throttle valve 28 is adjusted by an operator of the vehicle 10 by depressing an accelerator pedal (not shown) in conjunction with an adjustment to the amount of fuel being delivered into the cylinders based on a power or torque demand of the engine 12 or the wheels of the vehicle 10, which is interpreted by a controller based on a position of the accelerator pedal.

The controller may be powertrain control unit (PCU), may part of a larger control system, and may be controlled by various other controllers throughout the vehicle 10, such as a vehicle system controller (VSC). It should therefore be understood that the controller and one or more other controllers can collectively be referred to as a "controller" that controls various actuators in response to signals from various sensors to control functions such as starting/stopping engine 12, operating the engine 12 to provide wheel torque, select or schedule shifts of a transmission of the vehicle 10, etc.

The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the engine 12 or vehicle 10.

The engine 12 also includes an exhaust system 30. The exhaust system 30 is configured to direct exhaust gas away from the cylinders of the engine 12. The exhaust system 30 includes a first set of pipes, tubes, or conduits 32 that are configured direct exhaust gas away from the first bank of cylinders 14. The first set of pipes, tubes, or conduits 32 may include a first exhaust manifold 34 that directly receives the exhaust gas from the first bank of cylinders 14. The exhaust system 30 includes a second set of pipes, tubes, or conduits 36 that are configured direct exhaust gas away from the second bank of cylinders 16. The second set of pipes, tubes, or conduits 36 may include a second exhaust manifold 38 that directly receives the exhaust from the second bank of cylinders 16. The exhaust gas is channeled to one or more tail pipes (not shown), via the first set of pipes, tubes, or conduits 32 and the second set of pipes, tubes, or conduits 36, wherein the exhaust gas is dumped into the ambient surroundings. Intermediate components of the exhaust system 30 may be disposed between the exhaust manifolds 34, 38 and the one or more tailpipes. Such intermediate components may include one or more mufflers, one or more catalytic converters, a turbine 40 if the vehicle 10 includes the turbocharger 24, etc.

The engine 12 also include an exhaust gas recirculation system 42. The exhaust gas recirculation system 42 includes a first pipe, tube, or conduit 44 that is configured to direct a first portion of the exhaust gas away from the first set of pipes, tubes, or conduits 32 of the exhaust system 30 (i.e., the first pipe, tube, or conduit 44 is configured to direct the first portion of the exhaust gas away from the first bank of cylinders 14). More specifically, the first pipe, tube, or conduit 44 may be configured to direct the first portion of the exhaust gas away from the first exhaust manifold 34. The first pipe, tube, or conduit 44 may be comprised of one or more pipes, tubes, or conduits. A first exhaust gas recirculation valve 46 may be disposed along the first pipe, tube, or conduit 44 in order to control the amount of exhaust flowing through the first pipe, tube, or conduit 44. The first pipe, tube, or conduit 44 directs the first portion of the exhaust gas into an exhaust gas recirculation cooler 48. The first portion of the exhaust gas is then directed to a mixer 50 via a second pipe, tube, or conduit 45. The second pipe, tube, or conduit 45 may be comprised of one or more pipes, tubes, or conduits. The mixer 50 then delivers the first portion of the exhaust gas into the pipes, tubes, or conduits 20 of the air intake system 18.

The exhaust gas recirculation system 42 includes a third pipe, tube, or conduit 52 that is configured to direct a second portion of the exhaust gas away from the second set of pipes, tubes, or conduits 36 of the exhaust system 30 (i.e., the third pipe, tube, or conduit 52 is configured to direct the second portion of the exhaust gas away from the second bank of cylinders 16). More specifically, the third pipe, tube, or conduit 52 may be configured to direct the second portion of the exhaust gas away from the second exhaust manifold 38. The third pipe, tube, or conduit 52 may be comprised of one or more pipes, tubes, or conduits. A second exhaust gas recirculation valve 53 may be disposed along the third pipe, tube, or conduit 52 in order to control the amount of exhaust flowing through the third pipe, tube, or conduit 52. The third pipe, tube, or conduit 52 directs the second portion of the exhaust gas into the exhaust gas recirculation cooler 48. The first and second portions of the exhaust gas are segregated from each other when passing through the exhaust gas recirculation cooler 48. The second portion of the exhaust gas is then directed to the mixer 50 via a fourth pipe, tube, or conduit 54. The fourth pipe, tube, or conduit 54 may be comprised of one or more pipes, tubes, or conduits. The mixer 50 then delivers the second portion of the exhaust gas into the pipes, tubes, or conduits 20 of the air intake system 18.

Figure 2:
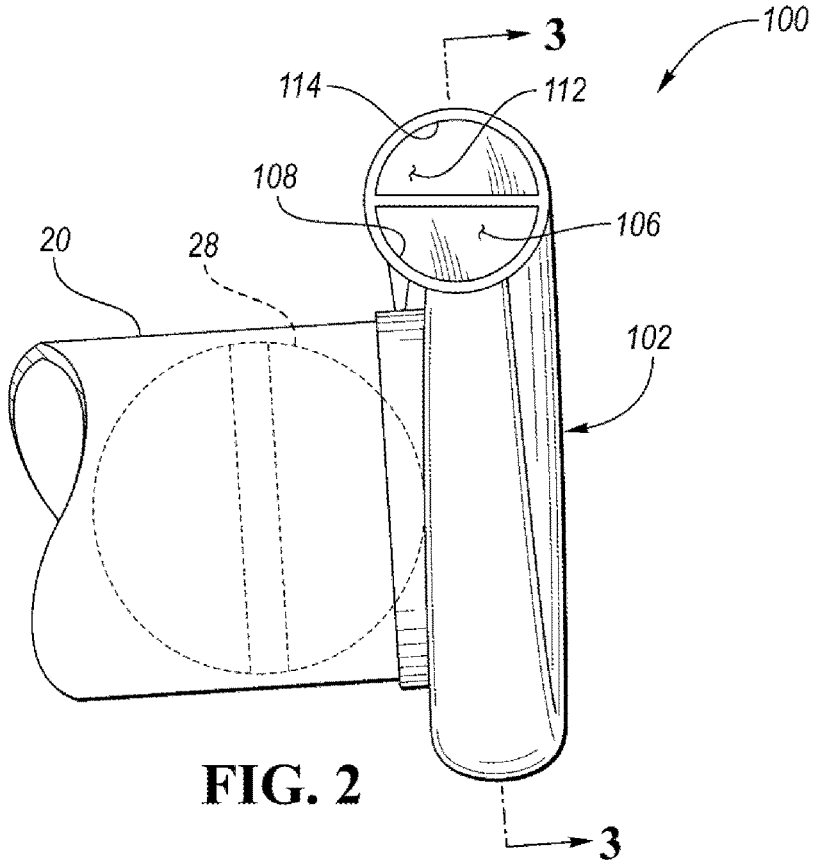
FIG. 2 is a first embodiment of a mixer for an exhaust gas recirculation system of the internal combustion engine.
Figure 3:
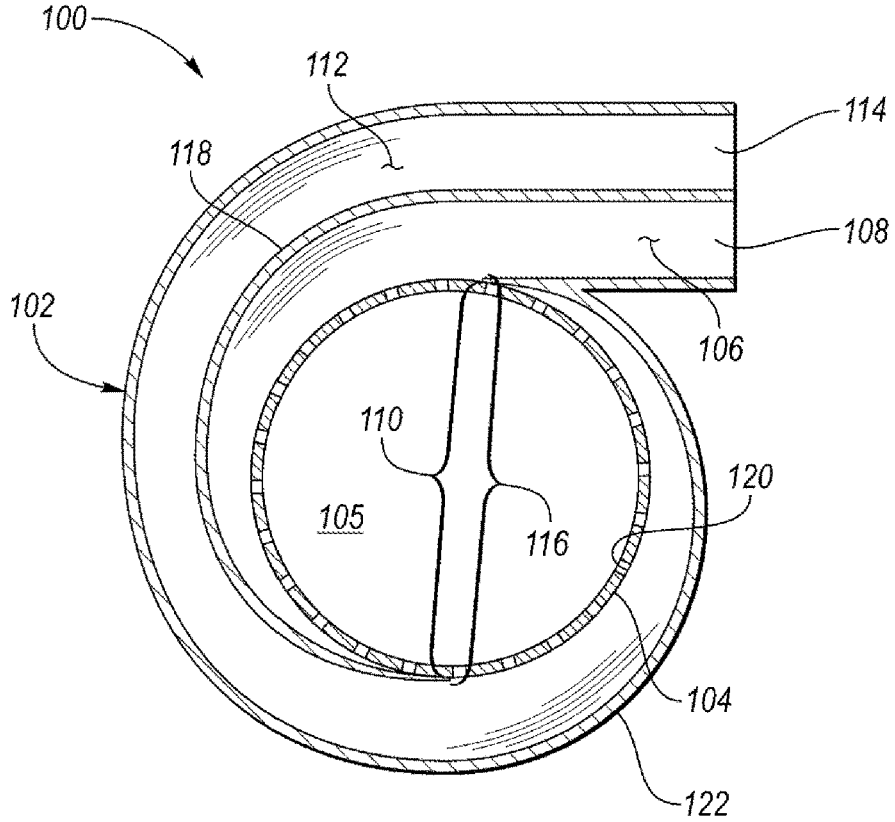
FIG. 3 is a cross-sectional view taken along line 3-3 in FIG. 2.

Referring to FIGS. 2 and 3, a first embodiment of a mixer 100 for an exhaust gas recirculation system is illustrated. The first embodiment of the mixer 100 may correspond to mixer 50 in FIG. 1. The mixer 100 is configured to direct the first and second portions of the exhaust gas from the second pipe, tube, or conduit 44 and the fourth pipe, tube, or conduit 54, respectively, into the pipes, tubes, or conduits 20 of the air intake system 18. The mixer 100 includes a housing 102 that forms an annular ring that is disposed about a perforated tube 104. Stated in other terms, the housing 102 may define a central opening 105 and the perforated tube 104 may be disposed in the central opening 105. The perforated tube 104 may comprise one of the pipes, tubes, or conduits 20 of the air intake system 18 that is downstream of the throttle value 28 and upstream of the intake manifolds 22. The mixer 100 is configured to segregate the first and second portions of the exhaust gas while the first and second portions of the exhaust gas are within the mixer 100. The mixer 100 is configured to direct the first and second portions of the exhaust gas into the air intake system 18 via the perforated tube 104.

The housing 102 defines a first conduit or chamber 106 extending between a first inlet 108 and a first outlet 110. The first inlet 108 is configured to establish fluid communication with the first set of pipes, tubes, or conduits 32 of the exhaust system 30 (or more specifically the first exhaust manifold 34) via the first pipe, tube, or conduit 44, exhaust gas recirculation cooler 48, and second pipe, tube, or conduit 45 of the exhaust gas recirculation system 42. The first outlet 110 is configured to establish fluid communication with the pipes, tubes, or conduits 20 of the air intake system 18 via the central opening 105 and the perforated tube 104 that is disposed within the central opening 105.

The housing 102 defines second conduit or chamber 112 extending between a second inlet 114 and a second outlet 116. The second inlet is configured to establish fluid communication with the second set of pipes, tubes, or conduits 36 of the exhaust system 30 (or more specifically the second exhaust manifold 38) via the third pipe, tube, or conduit 52, exhaust gas recirculation cooler 48, and fourth pipe, tube, or conduit 54 of the exhaust gas recirculation system 42. The second outlet 116 is configured to establish fluid communication with the pipes, tubes, or conduits 20 of the air intake system 18 via the central opening 105 and the perforated tube 104 that is disposed within the central opening 105. The first outlet 110 and the second outlet 116 may be defined on opposing half-rings that form the outer periphery of the central opening. The first outlet 110 and the second outlet 116 may each occupy the space that encompasses a portion of a half or an entire half of the outer periphery of the central opening 105.

The first conduit or chamber 106 is configured to direct the first portion of the exhaust gas from the first inlet 108 to the pipes, tubes, or conduits 20 of the air intake system 18 via the first outlet 110. The second conduit or chamber 112 is configured to direct the second portion of the exhaust gas from the second inlet 114 to the pipes, tubes, or conduits 20 of the air intake system 18 via the second outlet 116. The first conduit or chamber 106 and the second conduit or chamber 112 are segregated from each other within the housing 102 via a partition wall 118. The first conduit or chamber 106 and the second conduit or chamber 112 may extend parallel relative to each other within the housing 102. The partition wall 118 extends circumferentially about a center of the annular ring formed by the housing 102, within the annular ring formed by the housing 102, and between and inner diameter 120 and an outer diameter 122 of the annular ring formed by the housing 102.

Figure 4:
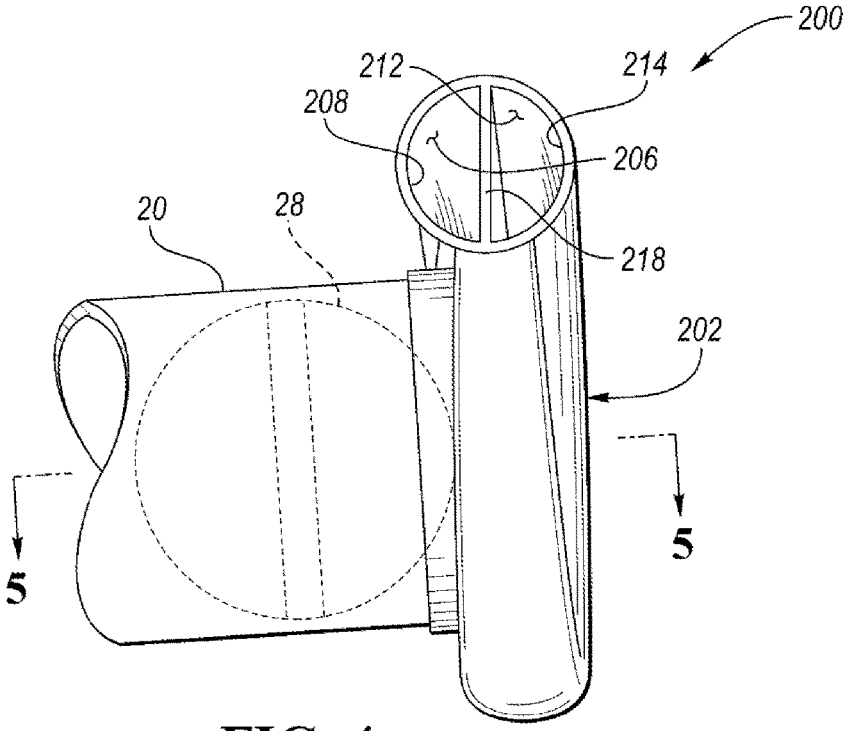
FIG. 4 is a second embodiment of the mixer for the exhaust gas recirculation system of the internal combustion engine.
Figure 5:
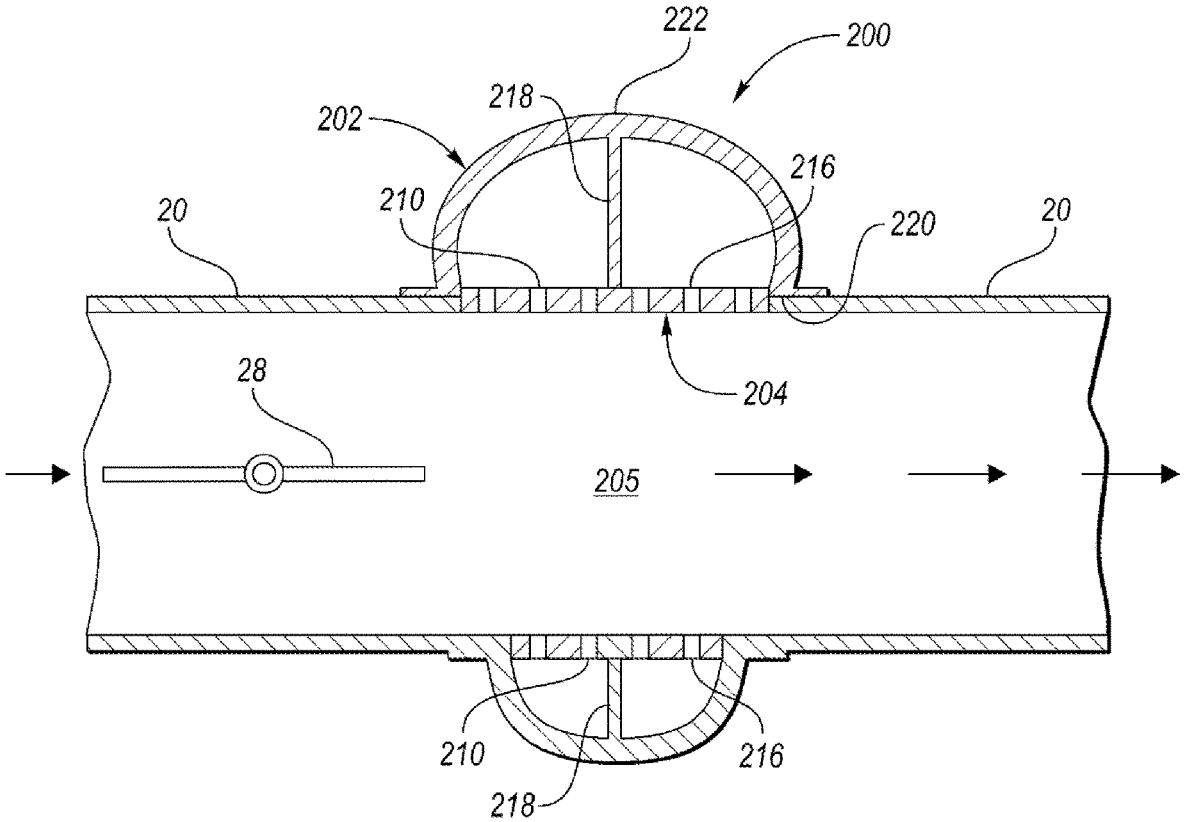
FIG. 5 is a cross-sectional view taken along line 5-5 in FIG. 4.

Referring to FIGS. 4 and 5, a second embodiment of a mixer 200 for an exhaust gas recirculation system is illustrated. The second embodiment of the mixer 200 may correspond to mixer 50 in FIG. 1. The mixer 200 is configured to direct the first and second portions of the exhaust gas from the second pipe, tube, or conduit 44 and the fourth pipe, tube, or conduit 54, respectively, into the pipes, tubes, or conduits 20 of the air intake system 18. The mixer 200 includes a housing 202 that forms an annular ring that is disposed about a perforated tube 204. Stated in other terms, the housing 202 may define a central opening 205 and the perforated tube 204 may be disposed in the central opening 205. The perforated tube 204 may comprise one of the pipes, tubes, or conduits 20 of the air intake system 18 that is downstream of the throttle value 28 and upstream of the intake manifolds 22. The mixer 200 is configured to segregate the first and second portions of the exhaust gas while the first and second portions of the exhaust gas are within the mixer 200. The mixer 200 is configured to direct the first and second portions of the exhaust gas into the air intake system 18 via the perforated tube 204.

The housing 202 defines a first conduit or chamber 206 extending between a first inlet 208 and a first outlet 210. The first inlet 208 is configured to establish fluid communication with the first set of pipes, tubes, or conduits 32 of the exhaust system 30 (or more specifically the first exhaust manifold 34) via the first pipe, tube, or conduit 44, exhaust gas recirculation cooler 48, and second pipe, tube, or conduit 45 of the exhaust gas recirculation system 42. The first outlet 210 is configured to establish fluid communication with the pipes, tubes, or conduits 20 of the air intake system 18 via the central opening 205 and the perforated tube 204 that is disposed within the central opening 205.

The housing 202 defines second conduit or chamber 212 extending between a second inlet 214 and a second outlet 216. The second inlet 214 is configured to establish fluid communication with the second set of pipes, tubes, or conduits 36 of the exhaust system 30 (or more specifically the second exhaust manifold 38) via the third pipe, tube, or conduit 52, exhaust gas recirculation cooler 48, and fourth pipe, tube, or conduit 54 of the exhaust gas recirculation system 42. The second outlet 216 is configured to establish fluid communication with the pipes, tubes, or conduits 20 of the air intake system 18 via the central opening 205 and the perforated tube 204 that is disposed within the central opening 205.

The first conduit or chamber 206 is configured to direct the first portion of the exhaust gas from the first inlet 208 to the pipes, tubes, or conduits 20 of the air intake system 18 via the first outlet 210. The second conduit or chamber 212 is configured to direct the second portion of the exhaust gas from the second inlet 214 to the pipes, tubes, or conduits 20 of the air intake system 18 via the second outlet 216. The first conduit or chamber 206 and the second conduit or chamber 212 are segregated from each other within the housing 202 via a partition wall 218. The first conduit or chamber 206 and the second conduit or chamber 212 may extend parallel relative to each other within the housing 202. The partition wall 218 extends within the annular ring formed by the housing 202, and from an inner diameter 220 toward an outer diameter 222, or vice versa, of the annular ring formed by the housing 202.

Figure 6:
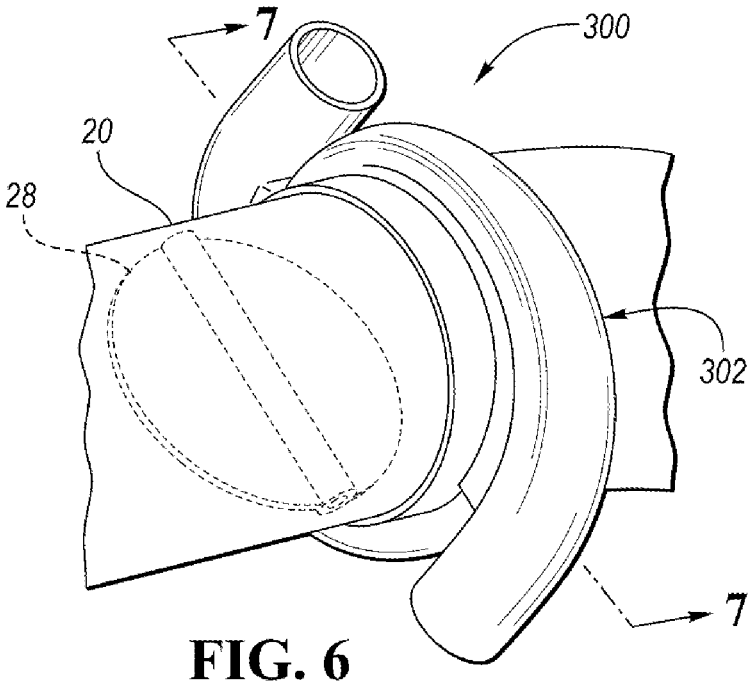
FIG. 6 is a third embodiment of the mixer for the exhaust gas recirculation system of the internal combustion engine.
Figure 7:
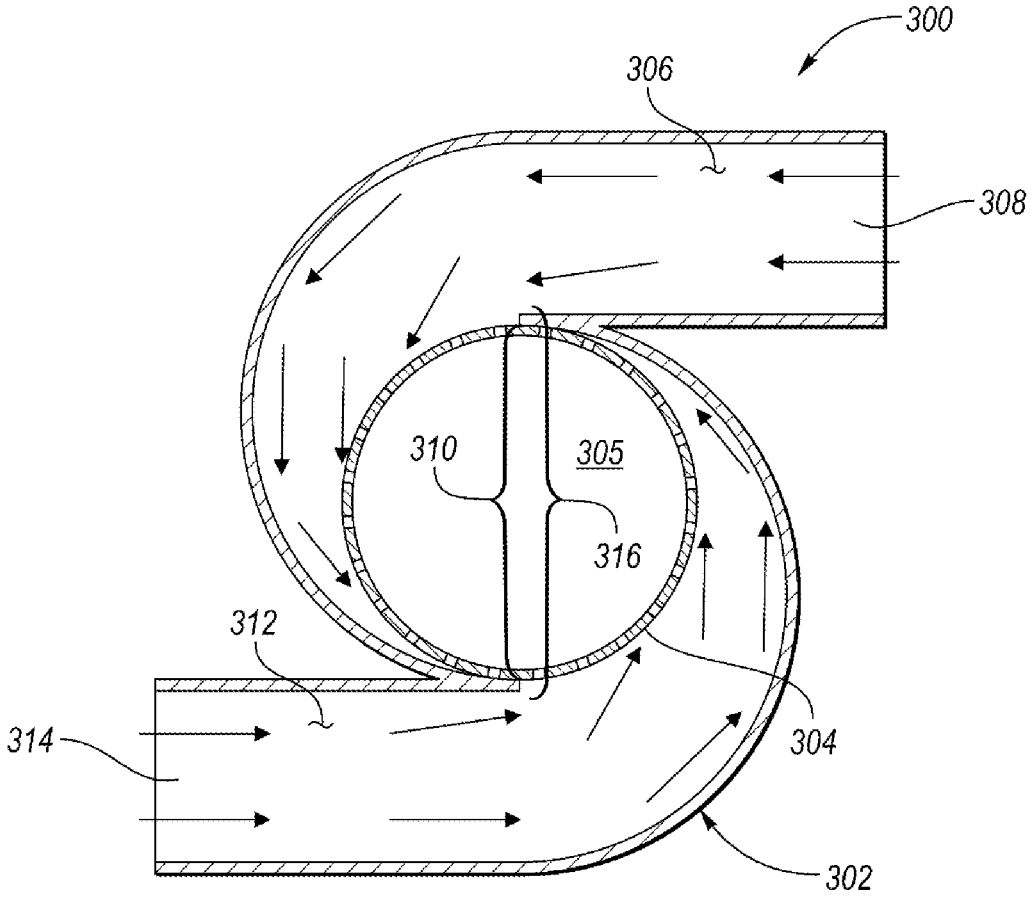
FIG. 7 is a cross-sectional view taken along line 7-7 in FIG. 6.

Referring to FIGS. 6 and 7, a third embodiment of a mixer 300 for an exhaust gas recirculation system is illustrated. The third embodiment of the mixer 300 may correspond to mixer 50 in FIG. 1. The mixer 300 is configured to direct the first and second portions of the exhaust gas from the second pipe, tube, or conduit 44 and the fourth pipe, tube, or conduit 54, respectively, into the pipes, tubes, or conduits 20 of the air intake system 18. The mixer 300 includes a housing 302 that forms an annular ring that is disposed about a perforated tube 304. Stated in other terms, the housing 302 may define a central opening 305 and the perforated tube 304 may be disposed in the central opening 305. The perforated tube 304 may comprise one of the pipes, tubes, or conduits 20 of the air intake system 18 that is downstream of the throttle value 28 and upstream of the intake manifolds 22. The mixer 300 is configured to segregate the first and second portions of the exhaust gas while the first and second portions of the exhaust gas are within the mixer 300. The mixer 300 is configured to direct the first and second portions of the exhaust gas into the air intake system 18 via the perforated tube 304.

The housing 302 defines a first conduit or chamber 306 extending between a first inlet 308 and a first outlet 310. The first inlet 308 is configured to establish fluid communication with the first set of pipes, tubes, or conduits 32 of the exhaust system 30 (or more specifically the first exhaust manifold 34) via the first pipe, tube, or conduit 44, exhaust gas recirculation cooler 48, and second pipe, tube, or conduit 45 of the exhaust gas recirculation system 42. The first outlet 310 is configured to establish fluid communication with the pipes, tubes, or conduits 20 of the air intake system 18 via the central opening 305 and the perforated tube 304 that is disposed within the central opening 305.

The housing 302 defines second conduit or chamber 312 extending between a second inlet 314 and a second outlet 316. The second inlet is configured to establish fluid communication with the second set of pipes, tubes, or conduits 36 of the exhaust system 30 (or more specifically the second exhaust manifold 38) via the third pipe, tube, or conduit 52, exhaust gas recirculation cooler 48, and fourth pipe, tube, or conduit 54 of the exhaust gas recirculation system 42. The second outlet 316 is configured to establish fluid communication with the pipes, tubes, or conduits 20 of the air intake system 18 via the central opening 305 and the perforated tube 304 that is disposed within the central opening 305. The first conduit or chamber 306 and the second conduit or chamber 312 may be defined on opposing half-rings of the annular ring formed by the housing 302. The first outlet 310 and the second outlet 316 may be defined on opposing half-rings that form the outer periphery of the central opening. The first outlet 310 and the second outlet 316 may each occupy the space that encompasses a portion of a half or an entire half of the outer periphery of the central opening 305.

The first conduit or chamber 306 is configured to direct the first portion of the exhaust gas from the first inlet 308 to the pipes, tubes, or conduits 20 of the air intake system 18 via the first outlet 310. The second conduit or chamber 312 is configured to direct the second portion of the exhaust gas from the second inlet 314 to the pipes, tubes, or conduits 20 of the air intake system 18 via the second outlet 316. The first conduit or chamber 306 and the second conduit or chamber 312 are defined on opposing sides of the housing 302 such that the first conduit or chamber 306 and the second conduit or chamber 312 are segregated from each other within the housing 302.

Figure 8:
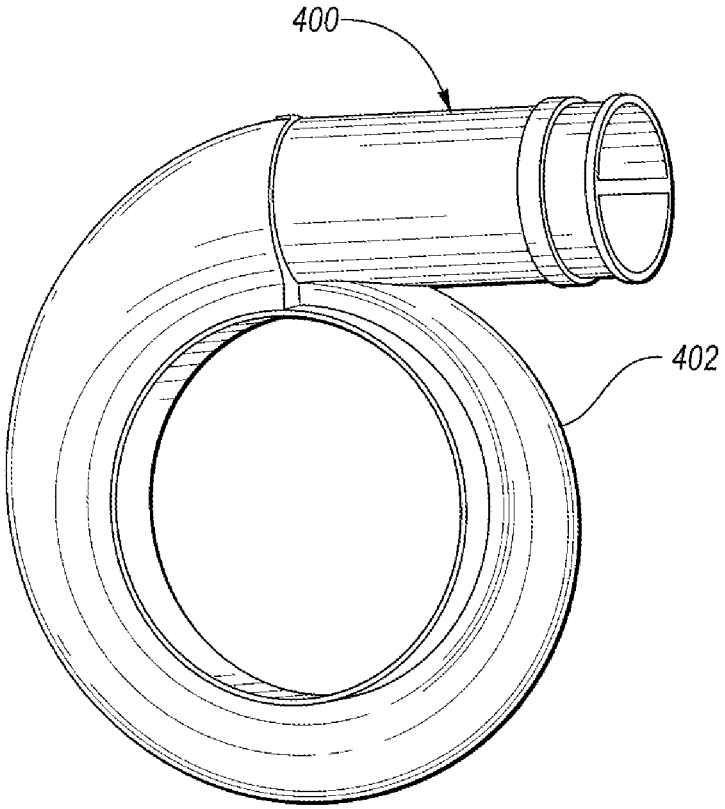
FIG. 8 is an example of a mixer that forms a continuous annular ring having a connected tongue.
Figure 9:
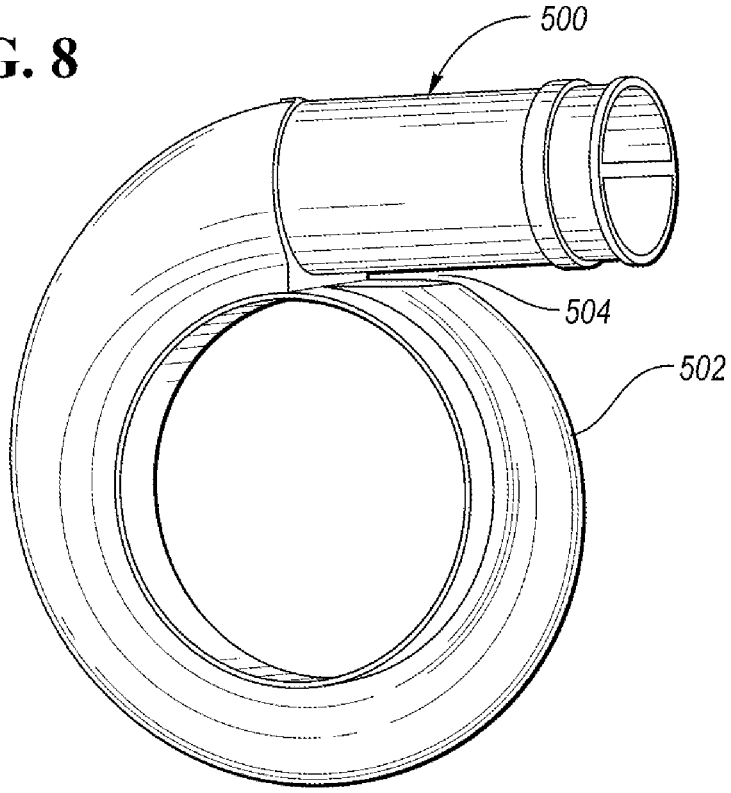
FIG. 9 is an example of a mixer that forms a discontinuous annular ring having a disconnected tongue.

Referring to FIG. 8, an example of a mixer 400 that forms a continuous annular ring having a connected tongue 402 is illustrated. Referring to FIG. 9, an example of a mixer 500 that forms a discontinuous annular ring having a disconnected tongue 502 illustrated. The disconnected tongue 502 is formed when a gap 504 is defined at one or more positions along the tongue 502.

It should be understood that the first and second chambers of each mixer described herein may also be configured to channel exhaust gas from a single source into the air intake system 18. For example, the first and second channels of each mixer may be configured to direct exhaust gas from a single cylinder, a single set of cylinders, or a single exhaust manifold into the air intake system 18. It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising:

an internal combustion engine having first and second cylinders;

an air intake system configured to deliver air to each of the first and second cylinders;

an exhaust system having, a first set of conduits configured to direct exhaust gas away from the first cylinder, and a second set of conduits configured to direct exhaust gas away from the second cylinder; and an exhaust gas recirculation system having, a first tube configured to direct a first portion of the exhaust gas away from the first set of conduits, a second tube configured to direct a second portion of the exhaust gas away from the second set of conduits, and a mixer configured to direct the first and second portions of the exhaust gas from the first and second tubes, respectively, into the air intake system, wherein the mixer forms an annular ring that is disposed about a perforated tube, is configured to segregate the first and second portions of the exhaust gas while the first and second portions of the exhaust gas are within the mixer, and is configured to direct the first and second portions of the exhaust gas into the air intake system via the perforated tube.

2. The vehicle of claim 1, wherein the annular ring defines first and second internal chambers configured direct the first and second portions of the exhaust gas from the first and second tubes, respectively, into the air intake system via the perforated tube.

3. The vehicle of claim 2, wherein the first and second internal chambers are segregated within the annular ring by a partition wall.

4. The vehicle of claim 3, wherein the partition wall extends within the annular ring from an inner diameter of the annular ring toward an outer diameter of the annular ring.

5. The vehicle of claim 3, wherein the partition wall extends circumferentially about a center of the annular ring, within the annular ring, and between inner and outer diameters of the annular ring.

6. The vehicle of claim 2, wherein the first and second internal chambers extend parallel relative to each other within the annular ring.

7. The vehicle of claim 2, wherein the first and second internal chambers are defined on opposing half-rings of the annular ring.

8. The vehicle of claim 1, wherein the perforated tube is a portion of the air intake system that is downstream of a throttle valve and upstream of an intake manifold.

9. An exhaust gas recirculation system for an engine comprising:

a first conduit configured to direct a first portion of exhaust gas away from a first exhaust manifold;

a second conduit configured to direct a second portion of exhaust gas away from a second exhaust manifold; and a mixer configured to direct the first and second portions of the exhaust gas from the first and second conduits, respectively, into an engine air intake system, wherein the mixer is arranged to segregate the first and second portions of the exhaust gas while the first and second portions of the exhaust gas are within the mixer, forms a ring about a perforated tube, and is configured to direct the first and second portions of the exhaust gas into the air intake system via the perforated tube.

10. The exhaust gas recirculation system of claim 9, wherein the ring defines first and second internal chambers that are configured to direct the first and second portions of the exhaust gas from the first and second conduits, respectively, into the air intake system via the perforated tube.

11. The exhaust gas recirculation system of claim 10, wherein the first and second internal chambers are segregated within the ring by a partition wall.

12. The exhaust gas recirculation system of claim 11, wherein the partition wall extends within the ring from an inner diameter of the ring toward an outer diameter of the ring.

13. The exhaust gas recirculation system of claim 11, wherein the partition wall extends circumferentially about a center of the ring, within the ring, and between inner and outer diameters of the ring.

14. The exhaust gas recirculation system of claim 10, wherein the first and second internal chambers extend parallel relative to each other within the ring.

15. The exhaust gas recirculation system of claim 10, wherein the first and second internal chambers are defined on opposing half-rings of the ring.

16. A mixer for an engine exhaust gas recirculation system comprising:

a housing forming an annular ring that defines a central opening, the housing further defining, a first conduit extending between a first inlet and a first outlet, wherein the first inlet is configured to establish fluid communication with at least one exhaust manifold and the first outlet is configured to establish fluid communication with an air intake conduit via the central opening, and a second conduit extending between a second inlet and a second outlet, wherein the second inlet is configured to establish fluid communication with the at least one exhaust manifold and the second outlet is configured to establish fluid communication with the air intake conduit via the central opening, and wherein the first and second conduits are segregated within the annular ring.

17. The mixer of claim 16, wherein the first and second conduits are segregated within the annular ring by a partition wall.

18. The mixer of claim 17, wherein the partition wall extends within the annular ring from an inner diameter of the annular ring toward an outer diameter of the annular ring.

19. The mixer of claim 17, wherein the partition wall extends circumferentially about a center of the annular ring, within the annular ring, and between inner and outer diameters of the annular ring.

20. The mixer of claim 16, wherein the first and second conduits are defined on opposing half-rings of the annular ring.

* * * * *